United States Patent [19]

Kishimoto et al.

[11] Patent Number: 4,672,176

[45] Date of Patent: Jun. 9, 1987

[54] ELECTRIC WARMER

[75] Inventors: Yoshio Kishimoto, Hirakata; Hideho Shinoda, Yamatokoriyama, both of Japan

[73] Assignee: Matsushita Electric Industrial Co., Ltd., Osaka, Japan

[21] Appl. No.: 717,103

[22] Filed: Mar. 28, 1985

[30] Foreign Application Priority Data

Apr. 2, 1984 [JP] Japan ..... 59-65377

[51] Int. Cl.[4] ..... H05B 1/02; H05B 3/02

[52] U.S. Cl. ..... 219/212; 219/505; 219/528; 219/549

[58] Field of Search ..... 219/212, 528, 529, 545, 219/548, 549, 505

[56] References Cited

U.S. PATENT DOCUMENTS 3,564,203 2/1971 Naoi et al. ..... 219/212

3,814,899 2/1974 Gordon et al. ..... 219/212

4,485,296 11/1984 Ueda et al. ..... 219/212

4,575,620 3/1986 Ishii et al. ..... 219/212

*Primary Examiner*—John Sipos

*Assistant Examiner*—Donald R. Studebaker

*Attorney, Agent, or Firm*—Stevens, Davis, Miller & Mosher

[57] ABSTRACT

In an electric warmer having a temperature sensor and a thermosensitive heater wire arranged in a body thereof, a thermal distance between the temperature sensor and the surface of the body is shorter than a thermal distance between the temperature sensor and the thermosensitive heater wire. The temperature of the thermosensitive heater wire is controlled to vary by a temperature sensing signal from the temperature sensor, thereby effecting comfortable warming of a user in response to the temperature of a thermal load formed by a contacting portion of the user's body.

18 Claims, 6 Drawing Figures

ELECTRIC WARMER

BACKGROUND OF THE INVENTION

1. Field of the Invention

This invention relates to an electric warmer such as an electric blanket, electric carpet or the like.

2. Description of the Prior Art

For detecting and controlling temperatures of the electric warmer, there have hitherto been used a temperature detector of a type utilizing separately a heater and a temperature sensor and the other temperature detector of a different type utilizing a thermosensitive heater having the form of a unitary structure of a heater and a temperature sensor. The above two types of temperature detectors differ greatly from each other in the temperature control mechanisms. Specifically, the temperature detector of the former type controls temperatures of a body of the electric warmer by detecting a temperature of a portion of the warmer body where the sensor is arranged and by controlling the generation of heat by the heater, while the temperature detector of the latter type controls temperatures of the heater by detecting a temperature of the heater and thereby controlling the temperature of the heater. However, it is impossible for both types of temperature detectors to control temperatures in accordance with various actual conditions of a user of the warmer.

SUMMARY OF THE INVENTION

An object of this invention is to provide an advanced electric warmer which can control temperatures by mainly detecting temperatures of a heat receiving contacting load on the part of a user (hereinafter referred to simple as a contacting load) such as body temperatures, skin temperatures, feet temperatures and clothes temperatures.

To accomplish the above object, according to this invention, a temperature sensor and a thermosensitive heater wire are arranged in an electric warmer body in such a manner that a thermal distance between the temperature sensor and the surface of the warmer body is smaller than a thermal distance between the temperature sensor and the thermosensitive heater wire, and a temperature sensing signal from the temperature sensor is used as a control signal for varying the temperature of the thermosensitive heater wire.

As is known in the art, a thermistor, a thermostat, and a thermistor having a positive temperature coefficient of resistance (hereinafter referred to as PTC) are typically used as temperature sensors. But, the most suited sensors for this invention are temperature sensors using a flexible temperature sensing wire or an optical fiber. The temperature sensing wire is constructed as shown in FIG. 1 and is featured by detecting an average temperature under a normal operating condition and by mainly controlling temperatures of a locally warmed portion under an abnormal operating condition (local warming). In FIG. 1, reference numeral 1 designates a core, 2 and 4 spiral electrodes, 3 a thermosensitive polymeric layer and 5 an insulating coating. The thermosensitive polymeric layer 3 is made of a thermistor material having a large thermistor constant B. The optical fiber sensor used as a temperature sensor, on the other hand, changes its light transmission characteristics dependently of temperatures, especially, increases its light transmission loss with increased temperatures. To this end, this type of temperature sensor preferably uses an optical fiber which decreases its light transmittance or changes a wavelength of the transmitting light. This optical fiber may include a core made of a material which exhibits a thermochromic or fluorescent property.

The thermosensitive heater wire used in this invention may preferably be a so-called monowire type thermosensitive heater of a construction as shown in FIG. 1 including the inner and outer spiral electrodes 2 and 4 used as a heat generating electrode and a signal electrode, respectively, and the interposed thermosensitive polymeric layer 3 made of a composition containing polyamide. With this thermosensitive heater wire, when the impedance of the thermosensitive polymeric layer interposed between the inner and outer electrode windings 2 and 4 changes with temperatures, this change is detected to control a current flowing through the heat generating electrode, thereby effecting temperature control. Another type of thermosensitive heater wire used in this invention may preferably be a PTC heater wire having a large positive temperature coefficient of resistance. Preferably, the PTC heater wire may be a flexible PTC heater wire as shown in FIG. 2, including cores 6 and 6', electrode conductors 7 and 7' respectively wound on the cores 6 and 6', a PTC heat generating layer 8 and a coating 9. The PTC heater wire may also be formed by using a PTC heat generating layer as the layer 3 in the structure shown in FIG. 1. A a PTC material used as the PTC heat generating layer 8 is made of a polymeric composition containing carbon black as conductive particles. The polymeric composition may include polyolefine such as ethylenevinyl acetate copolymer, ethylene-ethylacrylate copolymer, polyethylene, polypropylene, ethylenepropylene copolymer; polyamide; polyester; etc. Especially, crystalline copolymer exhibits a large PTC characteristic. Various kinds of copolymer described above may obviously be subjected to chemical or electron beam crosslinking treatments as occasion demands.

It is essential that the temperature sensor shown in FIG. 1 is arranged at a position as shown in FIG. 3B. Conventionally, as shown in FIG. 3A, a distance $L_1$ between the temperature sensor 10 and the thermosensitive heater wire 11 is smaller than a distance $L_2$ between the temperature sensor 10 and the surface of the warmer body, more specifically, a contacting load 12 above the warmer body in order that the temperature sensor 10 is so arranged as to detect temperatures of the thermosensitive heater wire 11 or temperatures of an inner part of the warmer body. In an embodiment of this invention, however, the relation of $L_1 > L_2$ is maintained as shown in FIG. 3B in order that the temperature sensor 10 can detect temperatures of the contacting load 12 more predominantly than temperatures of the thermosensitive heater wire 11. With this construction, a temperature control system can be obtained wherein a temperature of the contacting load 12 is mainly detected to provide a temperature signal for effecting interlinked control of the thermosensitive heater wire 11. Practically, the distances $L_1$ and $L_2$ are determined from the standpoint of a thermal distance based on thermal conductivity rather than from the standpoint of a geometrical distance.

Because of a large distance between the temperature sensor 10 and the thermosensitive heater wire 11, the aforementioned temperature control system is featured by the fact that the temperatures of the thermosensitive heater wire 11 can be varied and controlled in interlinked relationship with the temperature signal generated from the temperature sensor 10, and as a result, a temperature control can be obtained which can provide a temperature comfortable to the warmer user in accordance with a body temperature of the user. When the thermosensitive heater wire 11 of a PTC heater wire type is employed, the maximum temperature of the heater wire will not exceed an abrupt change point of the PTC characteristic. The aforementioned monowire type thermosensitive heater wire may also be used as a thermosensitive heater wire capable of controlling the heater temperature. In this type of thermosensitive heater wire, which uses at least one of the spiral electrodes of the temperature sensing wire as shown in FIG. 1 as the heat generating conductor, since the heat generation wattage value per unit length of the heat generating conductor is constant, every portion of the heat generating conductor generates the same quantity of heat. Hence, it results that a higher temperature rise occurs at a location where the thermosensitive heater wire has greater wire distribution density. This fact shows that, if an electric warmer such as an electric blanket, for example, is constructed to be of a type of keeping the head cool and the feet warm by having the thermosensitive heater wire distributed densely at its feet covering portion and coarsely at its breast covering portion, it is possible to provide a comfortable electric warmer which detects a temperature of a user's body and preferentially raises a temperature of its feet covering portion and then gradually warms the whole body of the user.

On the contrary, in the PTC heater wire, a large current flows at a lower temperature portion of the heater wire to generate a greater amount of heat at this portion, thereby causing a greater rise of temperature at this portion. The temperature sensor 10 having the characteristics of an optical fiber sensor or a thermistor detects an average temperature at a location where the sensor is placed, and it mainly produces a signal indicative of an average temperature at a higher temperature portion. More particularly, the temperature sensor 10 mainly detects a temperature at a higher temperature portion of the contacting load 12 and it operates to prevent uncomfortable feeling of the user due to thermal stimulation or night sweat from being produced during the operation of the warmer. While the monowire thermosensitive heater wire gives rise to a higher temperature rise at a location where the monowire thermosensitive heater wire has greater wiring density, the PTC heater wire has a self temperature control function of generating a larger quantity of heat at a lower temperature portion thereof and a smaller quantity of heat at a higher temperature portion thereof. Therefore, by the use of the PTC heater wire, it is possible to obtain a warmer system which is balanced as a whole and can give comfortable feeling to a user who uses an electric warmer especially such as an electric carpet.

In comparison with the prior art system, the features and meritorious effects of the electric warmer of this invention are summarized as follows:

(1) An excellent warmer can be obtained which can control temperatures in interlinked relationship with a temperature of the contacting load of a user of the warmer;

(2) It is possible to prevent an excessive heater temperature rise and to provide a comfortable warmer which is responsive to temperatures of the contacting load of the user (body temperatures, skin temperatures, feet temperatures and clothes temperatures);

(3) The present invention is applicable to many temperature controlled devices such as electric blanket, carpet, lap robe, bedclothes, etc. which operate to warm the contacting load; and (4) When the PTC heater wire is used as the thermosensitive heater wire, a comfortable warmer can be obtained, wherein the temperature at a lower temperature portion of the heater wire rises predominantly and sharply thereby to cause a rapid temperature rise especially at a lower temperature portion of the contacting load of the user.

DESCRIPTION OF PREFERRED EMBODIMENTS

Figure 1:
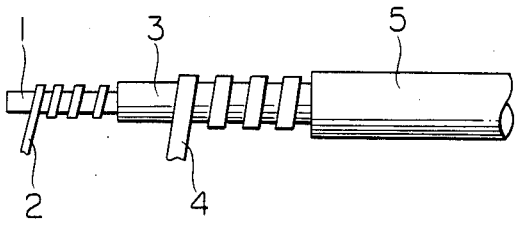
FIG. 1 a fragmentary view, partly exploded, showing an example of a thermosensitive heater wire and a temperature sensing wire.
Figure 4:
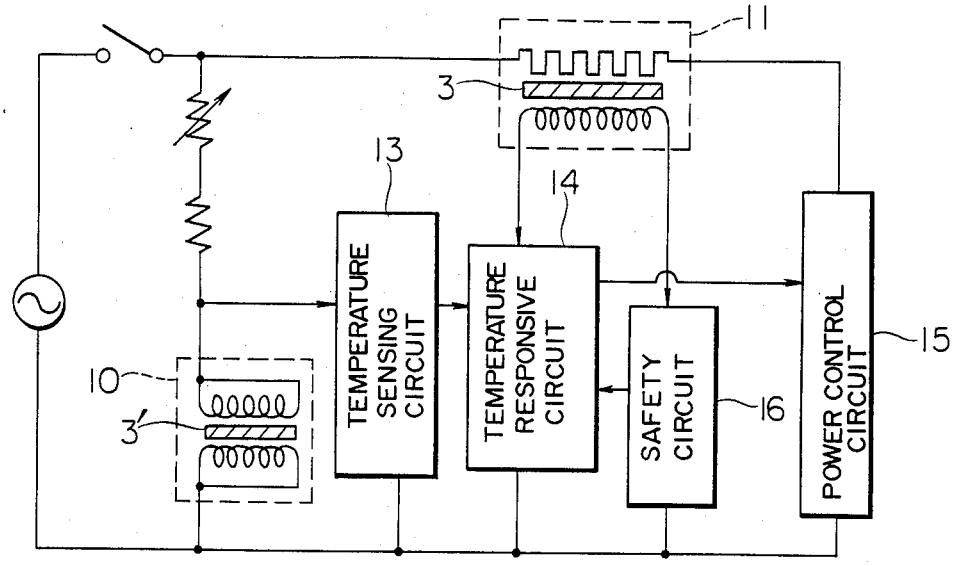
FIG. 4 is a block diagram showing a temperature control circuit of an embodiment of the present invention employing the temperature sensor and the monowire type thermosensitive heater wire.

Referring to FIG. 4, a first embodiment of the invention will be described. In this embodiment, a thermosensitive heater wire 11 of the monowire type of a rating of 100 V/105 W and a length of 24.5 m is disposed in an electric blanket body. This thermosensitive heater wire 11 has a construction shown in FIG. 1 including the thermosensitive polymeric layer 3 of an electrostatic capacitance change type made of a nylon composition. The inner and outer spiral electrodes 2 and 4 are made of a copper alloy and the coating 5 is made of a soft vinyl chloride composition. The thermosensitive heater wire 11 of the electric blanket is arranged with a pattern having an inter-wire distance of about 8 cm. A separate temperature sensing wire of 16 m length composing a temperature sensor 10 is arranged to be 4 cm apart from the thermosensitive heater wire 11, that is, intermediate of the inter-wire distance of the thermosensitive heater wire 11. This temperature sensing wire, which composes the temperature sensor 10, has a construction also shown in FIG. 1 and includes a thermosensitive polymeric layer 3' made of an ionic conduction type polyvinyl chloride composition and spiral electrodes 2 and 4 formed of a stainless wire. The thermosensitive heater wire 11 and the temperature sensor 10 are connected as shown in FIG. 4 and the temperature setting thereof is made. A temperature sensing circuit 13 detects temperature signals from the temperature sensor 10. A temperature responsive circuit 14 takes the form of an integrated circuit. A power control circuit 15 employs a thyristor. A temperature signal from the thermosensitive heater wire 11 operates the temperature responsive circuit 14 which is also responsive to a temperature sensing signal from the temperature sensing circuit 13 so that the temperature responsive circuit 14 produces an output signal, which is supplied to the power control circuit 15 being interlinked with the temperature sensing signal from the temperature sensing circuit 13, to effect temperature control of the thermosensitive heater wire 11. More specifically, when the temperature sensed by the temperature sensor 10 is low, that is, when the blanket has not been warmed, or the skin temperature is low, the temperature of the thermosensitive heater wire 11 is set so as to shift toward a higher value. As an example, in a warmer wherein, when the temperature sensed by the temperature sensor 10 is 40° C., the temperature of the thermosensitive heater wire 11 is controlled at a temperature of 45° C., the temperature of the thermosensitive heater wire 11 is raised to 50° C., if the sensed temperature falls to 35° C., and, conversely, it is lowered, if the sensed temperature rises. By setting the temperature of the thermosensitive heater wire 11 in this way, power supply to the thermosensitive heater wire 11 can be interrupted by the power control circuit 15 when the set temperature is reached. Reference numeral 16 designates a safety circuit which supplies an output signal to the temperature responsive circuit 14 so that the latter in turn supplies an interruption control signal to the power control circuit 15, when an abnormal temperature rise is sensed in the blanket. It has been found that this blanket gives comfortable feeling to a user sleeping in his bed using this blanket, by virtue of its warming characteristics such that the temperature of the heater wire rises when the skin temperature is low and the user's hands and feet are cold, while, the temperature of the heater wire falls when the user's body has been sufficiently warmed.

Figure 2:
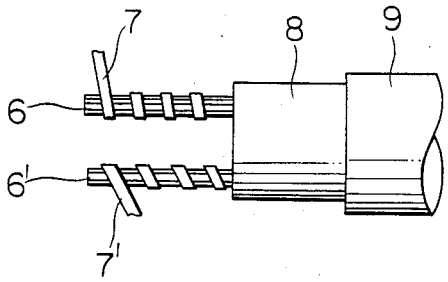
FIG. 2 is a similar view showing another example of the thermosensitive heater wire.
Figure 3A:
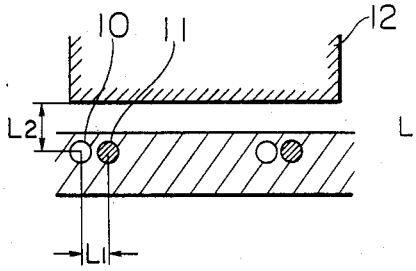
FIG. 3A PRIOR ART
FIG. 3A is a diagram for explaining the positional relationship between the temperature sensor and the thermosensitive heater wire of the prior art warmer.
Figure 3B:
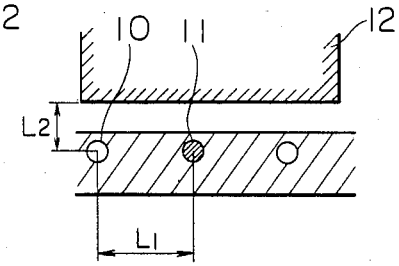
FIG. 3B is a similar diagram for explaining that of the warmer of the present invention.
Figure 5:
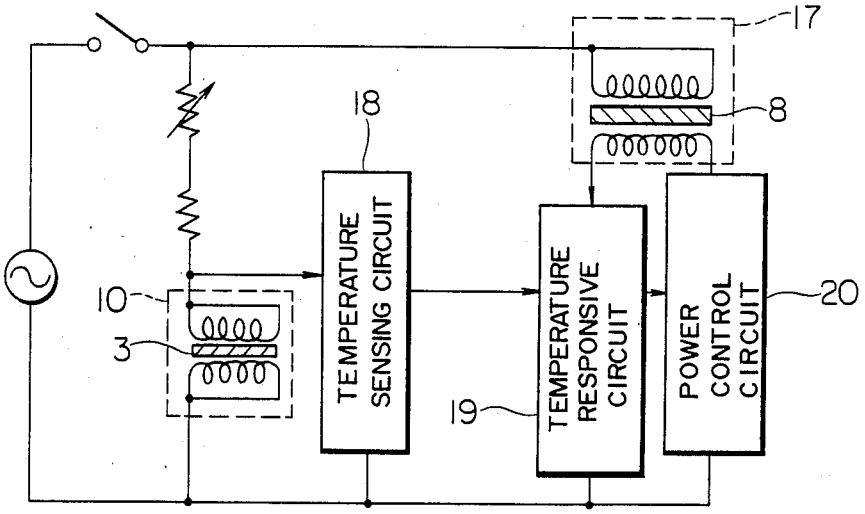
FIG. 5 is a block diagram showing a temperature control circuit of another embodiment of the present invention employing the temperature sensor and the PTC heater wire.

Referring to FIG. 5, a second embodiment of the present invention will be described. In this embodiment, a thermosensitive heater wire 17 of the PTC type of a rating of 100 V/150 W (20° C.) and a length of 24.5 m is disposed in an electric blanket cloth. This thermosensitive heater wire 17 has a construction shown in FIG. 2 and includes the PTC heat generating layer 8 made of an ethylene-vinyl acetate copolymer composition containing carbon black. The paired electrode conductors 7 and 7' are made of a copper alloy, and the coating 9 is made of a soft vinyl chloride composition. The wiring pattern in the blanket is similar to that of the first embodiment. The thermosensitive heater wire 17 is disposed in the blanket in the same manner as that of the first embodiment, and the temperature sensing wire composing a temperature sensor 10, which is identical with that of the first embodiment, is used and arranged in the same manner. The thermosensitive heater wire 17 and the temperature sensor 10 are connected as shown in FIG. 5 and the temperature setting thereof is made. The temperature responsive circuit 19 detects the temperature of the PTC heater wire 17 by making use of the positive temperature coefficient of resistance of the PTC heater itself and produces an output signal which is supplied to a power control circuit 15. The temperature sensing signal from the temperature sensor 10 is detected by a temperature sensing circuit 18, and an output signal of the temperature sensing circuit 18 is supplied to the temperature responsive circuit 19. Thus, the output signal of the temperature responsive circuit 19 is interlinked with the output signal from the temperature sensing circuit 18, and it effects temperature control of the thermosensitive heater wire 17. The power control circuit 20 uses a thyristor. A temperature test conducted on this blanket revealed that, in the same manner as the first embodiment, the temperature of the thermosensitive heater wire 17 is shifted to a higher value when the temperature sensed by the temperature sensor 10 is low. This blanket gives comfortable feeling to a user sleeping in his bed employing this blanket, by virtue of its warming characteristics such that the temperature of the heater wire 17 near the user's skin of a low temperature and the cold hands and feet of the user rises sharply, while, the temperature of the heater wire 17 lowers when the user's body has been warmed sufficiently.

As described above, the warmer of this invention operates to shift the controlled temperature of the thermosensitive heater wire 17 in accordance with the temperature of the contacting load, thereby making it possible to effect close temperature control. Therefore, it is possible to reduce the magnitude of a temperature change caused by the ON-OFF operations of the heater, thereby making it possible to provide a comfortable warmer which allows its user to enjoy excellent feeling.

We claim:

1. An electric warmer comprising:

an electric warmer body having a surface which contacts a heat receiving load;

a temperature sensor and a thermosensitive heater wire arranged in said electric warmer body in such a manner that a thermal distance between said temperature sensor and the surface of said electric warmer body is shorter than a thermal distance between said temperature sensor and said thermosensitive heater wire; and a control circuit for controlling a temperature of said thermosensitive heater wire responsive to an output signal from said temperature sensor and adapted to shift the controlled temperature of said thermosensitive heater wire to an elevated or reduced value when a temperature of said heat receiving load sensed by said temperature sensor is low or high, respectively.

2. An electric warmer according to claim 1, wherein said temperature sensor comprises a flexible temperature sensing wire having a thermosensitive polymeric layer interposed between a pair of electrodes.

3. An electric warmer according to claim 1, wherein said temperature sensor comprises an optical fiber temperature sensor.

4. An electric warmer according to claim 1, wherein said electric warmer body is constructed in the form of an electric blanket.

5. An electric warmer according to claim 1, wherein said electric warmer body is constructed in the form of an electric carpet.

6. An electric warmer comprising:

an electric warmer body having a surface which contacts a heat receiving load;

a temperature sensor and a thermosensitive heater wire arranged in said electric warmer body in such a manner that a thermal distance between said temperature sensor and the surface of said electric warmer body is shorter than a thermal distance between said temperature sensor and said thermosensitive heater wire, said thermosensitive heater wire comprising a thermosensitive polymeric layer containing polyamide interposed between a spiral heating electrode and a spiral signal electrode; and a control circuit for controlling a temperature of said thermosensitive heater wire responsive to an output signal from said temperature sensor and adapted to shift the controlled temperature of said thermosensitive heater wire to an elevated or reduced value when a temperature of said heat receiving load sensed by said temperature sensor is low or high, respectively.

7. An electric warmer according to claim 6, wherein said temperature sensor comprises a flexible temperature sensing wire having a thermosensitive polymeric layer interposed between a pair of electrodes.

8. An electric warmer according to claim 6, wherein said temperature sensor comprises an optical fiber temperature sensor.

9. An electric warmer according to claim 6, wherein said electric warmer body is constructed in the form of an electric blanket.

10. An electric warmer according to claim 6, wherein said electric warmer body is constructed in the form of an electric carpet.

11. An electric warmer comprising:

an electric warmer body having a surface which contacts a heat receiving load;

a temperature sensor and a thermosensitive heater wire arranged in said electric warmer body in such a manner that a thermal distance between said temperature sensor and the surface of said electric warmer body is shorter than a thermal distance between said temperature sensor and said thermosensitive heater wire, said thermosensitive heater wire being made of a material having a large positive temperature coefficient of resistance; and a control circuit for controlling a temperature of said thermositive heater wire responsive to an output signal from said temperature signal adapted to shift the controlled temperature of said thermosensitive heater wire to an elevated or reduced value when a temperature of said heat receiving load sensed by said temperature sensor is low or high, respectively.

12. An electric warmer according to claim 11, wherein said temperature sensor comprises a flexible temperature sensing wire having a thermosensitive polymeric layer interposed between a pair of electrodes.

13. An electric warmer according to claim 11, wherein said temperature sensor comprises an optical fiber temperature sensor.

14. An electric warmer according to claim 11, wherein said electric warmer body is constructed in the form of an electric blanket.

15. An electric warmer according to claim 11, wherein said electric warmer body is constructed in the form of an electric carpet.

16. An electric warmer comprising:

an electric warmer body having a surface which contacts the body of a user of said electric warmer;

a temperature sensor and a thermosensitive heater wire arranged in said electric warmer body in such a manner that a thermal distance between said temperature sensor and the surface of said electric warmer body is shorter than a thermal distance between said temperature sensor and said thermosensitive heater wire, said thermosensitive heater wire being distributed more densely beneath the portion of the surface of said electric warmer body which is adapted to be in contact with the feet of the user; and a control circuit for controlling a temperature of said thermosensitive heater wire responsive to an output signal from said temperature sensor and adapted to shift the controlled temperature of said thermosensitive heater wire to a higher or lower value when a temperature of the trunk portion of the user in contact with the surface of said electric warmer body is low or high, respectively.

17. An electric warmer according to claim 16, wherein said thermosensitive heater wire comprises a thermosensitive polymeric layer containing polamide interposed between a spiral heating electrode and a spiral signal electrode.

18. An electric warmer according to claim 16, wherein said electric warmer body is constructed in the form of an electric blanket.

* * * * *